United States Patent [19]

Gea Aizpurua

[11] Patent Number: 4,763,698

[45] Date of Patent: Aug. 16, 1988

[54] CAM UNIT INCORPORATING BATTEN FOR CONTROLLING THE REED OF WEAVING LOOMS

[75] Inventor: Jose A. Gea Aizpurua, Guipuzcoa, Spain

[73] Assignee: D. Joaquin Aperribay Elosua, San Sebastian, Spain

[21] Appl. No.: 942,378

[22] Filed: Dec. 16, 1986

[30] Foreign Application Priority Data

Dec. 16, 1985 [FR] France ..... 85 18814

[51] Int. Cl.[4] ..... D03D 49/60

[52] U.S. Cl. ..... 139/190; 74/567

[58] Field of Search ..... 139/188, 190, 79, 81; 74/567, 568

[56] References Cited

U.S. PATENT DOCUMENTS

| | | | |
|---|---|---|---|
| 2,604,123 | 7/1952 | Budzyna et al. | 139/446 |
| 4,076,048 | 2/1978 | Bolleter et al. | 139/190 |
| 4,577,666 | 3/1986 | Kathriner | 139/190 |

*Primary Examiner*—Henry S. Jaudon

*Attorney, Agent, or Firm*—Dowell & Dowell

[57] ABSTRACT

A cam unit incorporating batten for controlling the reed of a weaving loom wherein the two members which support the double lever rollers and the conjugate discs of a double drive cam are provided in the form of bushings having end portions extending outside of a housing and which end portions are adapted to be selectively secured to rotatable shafts so that the cam unit may be positioned at any desired location relative to the shafts.

3 Claims, 2 Drawing Sheets

CAM UNIT INCORPORATING BATTEN FOR CONTROLLING THE REED OF WEAVING LOOMS

BACKGROUND OF THE INVENTION

1. Field of the Invention

The present invention relates to weaving looms and more particularly to cam units incorporating batten which are adapted to ensure control of the oscillating reed holder.

2. History of the Related Art

In conventional weaving looms, the cam units for controlling the oscillating reed holder comprise a housing inside which are mounted two shafts which are oriented parallel to each other and whose ends project on either side of the lateral faces of the housing. On one of these shafts is fixed a set of conjugate cams against which roll two follower rollers carried by a double lever which is angularly secured with the other shaft. This arrangement is such that the continuous rotation of the first shaft creates an oscillatory movement of the second.

Taking into account the length of the reed holder, the oscillating control thereof necessitates at least two cam units of the above type. This requires that the shafts of these two units be connected in pairs with the aid of connections and intermediate shafts. This assembly represents a delicate assembly of components that must be accurately aligned and positioned.

SUMMARY OF THE INVENTION

It is a principal object of the present invention to overcome the aforementioned drawback, essentially by construction each of the shafts of the cam unit in the form of bushes adapted to be axially traversed by spindles of any desired length.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
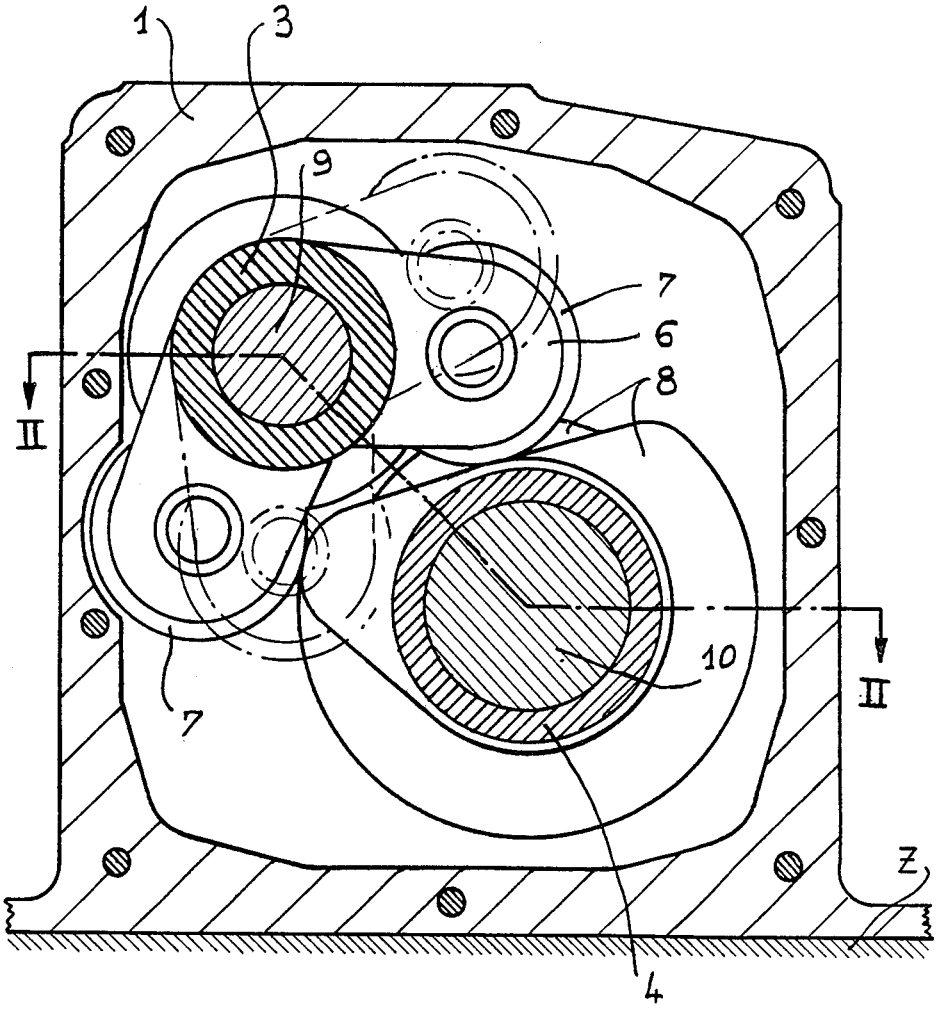
FIG. 1 is a schematic vertical section through a cam unit incorporating batten made in accordance with the present invention.
Figure 2:
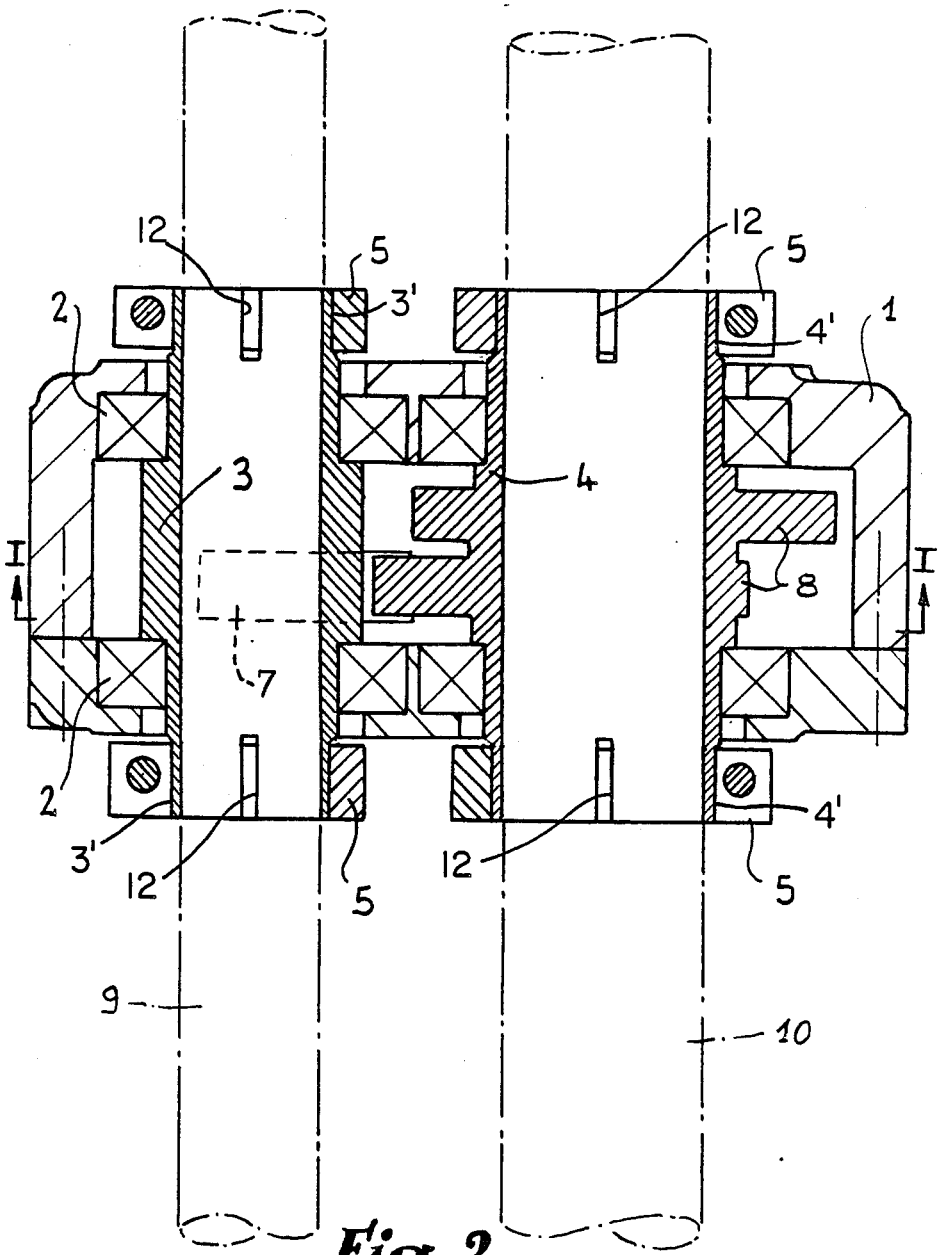
FIG. 2 is a horizontal section taken along plane II—II taken for the FIG. 1; the plane of section of FIG. 1 is shown in this Figure as I—I.

Referring now to the drawings, reference 1 designates a housing mounted to the loom frame Z formed by the hermetic assembly of two pieces, the opposite principal or end walls of this housing 1 being equipped with two pairs of ball or needle bearings 2. The aligned bearings 2 rotatably support bushings 3, 4, respectively, oriented parallel to each other; the ends 3' and 4' of each of these bushings 3, 4 project slightly beyond the lateral or end walls of housing 1 and thereby define end pieces which are split longitudinally at 12 in order to cooperate with clamps 5 for purposes that will be set forth hereinbelow.

The central part of bushing 3 is shaped so as to form a double lever 6 of which each of the ends is equipped with a follower roller 7. In the same way, the central part of bushing 4 is arranged so as to present two parallel discs 8, profiled in the manner of the two conjugate elements of a double cam. The rollers 7 engage and follow the periphery of the discs 8. Under these conditions, is will be appreciated that, if bushing 4 is continuously driven in rotation, bushing 3 will, on the other hand, be oscillated and thereby moved in the same manner as in the conventional cam units.

However, it should be noted that the tubular form of members 3 and 4 considerably simplifies the installation of the cam unit on the loom. In fact, each of bushings 3 and 4 is capable of being traversed by a shaft 9, 10, respectively. The first of these shafts is secured with the arms which support the reed holder of the loom in question, while the second is angularly connected to the principal shaft of the loom.

The shafts 9 and 10 may obviously be of any length, so that, whatever the width of the loom and the length of the oscillating reed holder, any connection of shafts is dispensed with as the same shaft 9 or 10 is capable of axially traversing any number of devices which are secured to the corresponding bushing 3 or 4 with the aid of clamps 5 which urge the end portions 3' and 4' against the corresponding shafts.

Under these conditions, such an arrangement ensures a geometry and rigidity which is much more favourable than in the conventional loom constructions.

It must, moreover, be understood that the foregoing description has been given only by way of example and that it in no way limits the domain of the invention which would not be exceeded by replacing the details of execution described by any other equivalents.

What is claimed is:

1. A loom batten drive comprising, a cam unit for controlling the rotary oscillating movement of a first shaft by a second rotatable shaft extending parallel to the first shaft, said cam unit including first and second lever means which are adapted to be driven by engagement with first and second elements of a double cam, said first and second layer means being carried by said first oscillating shaft and said double cam being carried by said second rotatable shaft, a housing having first and second sections and opposite end walls, two pair of opposing openings formed in said end walls of said housing through which said first and second shafts are extended, said first and second lever means being supported on a first generally cylindrical bushing which is selectively mounted to said first oscillating shaft so as to be substantially enclosed within said housing, said double cam being supported on a second generally cylindrical bushing which is selectively mounted to said second rotatable shaft so as to be substantially enclosed within said housing, each of said first and second bushings having opposite outer end end portions which extend outwardly through said pairs of opposing openings in said end walls, and clamping means for urging said outer end portions of said first and second bushings into secured engagement with said first and second shafts.

2. The cam unit of claim 1 in which each of said outer end portions of each of said first and second bushings include longitudinal slits which permit said outer end portions to be collapsed about said first and second shafts by said clamping means.

3. The cam unit of claim 2 including a plurality of bearing means mounted within said housing, said bearing means being disposed between each of said first and second bushings and said housing.

* * * * *